US010526778B2

(12) United States Patent
Wiedemann

(10) Patent No.: US 10,526,778 B2
(45) Date of Patent: Jan. 7, 2020

(54) VEHICLE FOR CLEANING SEWERS

(71) Applicant: Karl Wiedemann, Welden (DE)

(72) Inventor: Karl Wiedemann, Welden (DE)

( * ) Notice: Subject to any disclaimer, the term of this patent is extended or adjusted under 35 U.S.C. 154(b) by 339 days.

(21) Appl. No.: 15/497,686

(22) Filed: Apr. 26, 2017

(65) Prior Publication Data

US 2017/0342699 A1 Nov. 30, 2017

(30) Foreign Application Priority Data

May 25, 2016 (DE) ..... 10 2016 006 276

(51) Int. Cl.
*E03F 7/10* (2006.01)
*E03F 9/00* (2006.01)

(52) U.S. Cl.
CPC ..... *E03F 7/106* (2013.01); *E03F 9/007* (2013.01)

(58) Field of Classification Search
CPC ... E03F 7/10; E03F 7/103; E03F 7/106; E03F 9/00; E03F 9/007
See application file for complete search history.

(56) References Cited

U.S. PATENT DOCUMENTS 4,922,571 A * 5/1990 Driear ..... E03F 7/10 134/168 C
6,438,792 B1 * 8/2002 Cappellotto ..... E03F 7/10 15/302

FOREIGN PATENT DOCUMENTS

AT 403712 B 5/1998
DE 3813419 A1 11/1989

* cited by examiner

*Primary Examiner* — Andrew A Horton
(74) *Attorney, Agent, or Firm* — Falk Ewers; Ewers IP Law PLLC

(57) ABSTRACT

In a sewer cleaning vehicle is provided having a container for the water required for cleaning the sewer and/or the sludge obtained during cleaning of the sewer, and an extension arm which is liftable and lowerable and/or rotatable about a vertical axis and which is accommodated on the container for the manipulation of a flushing hose which can be supplied with compressed water and which can be inserted into the sewer. A suction hose with a suction draft can be lowered into the sewer. At least one further working device which is provided for working the sewer and which can be manipulated by the extension arm is carried along on the vehicle and can be loosely accommodated on an associated retaining device provided on the vehicle side and can releasably be coupled to the extension arm when required by an associated coupling device.

14 Claims, 3 Drawing Sheets

VEHICLE FOR CLEANING SEWERS

CROSS REFERENCE TO RELATED APPLICATIONS

This application claims priority from German patent application DE 10 2016 006 276.2, filed May 25, 2016, the entire content of which is incorporated herein by reference.

TECHNICAL FIELD

The invention relates to a vehicle for cleaning sewers etc., including a container for the water required for cleaning the sewer and/or the sludge obtained during the cleaning of the sewer, and a liftable and lowerable extension arm, which is accommodated on the container and is preferably rotatable about a vertical axis, for the purpose of manipulating a flushing hose which can be supplied with compressed water and can be inserted into the sewer, and/or a suction hose which can be supplied with a suction draft and can be lowered into the sewer.

BACKGROUND

Sewer-cleaning vehicles of this kind are known in numerous embodiments. The work that can be carried out in the sewer with said vehicles primarily concerns cleaning processes. Additional working devices are usually required for other work in the sewer which goes beyond the cleaning of said sewer. If such additional working devices are provided, they must be brought to the place of work and manipulated there. If a sewer-cleaning vehicle could be used for this purpose, its range of use would be increased and its economic viability would be improved.

SUMMARY

In view of the above, it is therefore an object of the present invention to provide a sewer-cleaning vehicle of the kind mentioned above with a comparatively broad range of uses.

This object is achieved in such a way that in a vehicle of the kind mentioned above a further working device provided for work in the sewer can be carried along by said vehicle, which is loosely accommodated on an associated retaining device on the vehicle side and can be manipulated by the extension arm, and which can releasably be coupled by an associated coupling device to the extension arm and can thus be manipulated by the extension arm as designated and can be brought out of engagement with the retaining device.

Since the additional working device can be accommodated loosely on the vehicle and can releasably be coupled to the extension arm when required, it is ensured that the additional working device, if it should be used, is removed from the retaining device by the extension arm, is manipulated as intended in use and can be returned to the retaining device after terminating the use thereof. Furthermore, it can be secured by the extension arm during travel of the vehicle. As long as the working device is not required, it need not be suspended on the extension arm, as a result of which it is not impaired during other work and no respective space is used up on the extension arm. Since the additional working device is neither connected to the retaining device on the vehicle side nor to the extension arm, but is removable therefrom, there is also the advantageous possibility to provide different working devices which form exchangeable units and are only carried along on the vehicle and attached to the extension arm when needed.

Advantageous embodiments and appropriate further developments of the higher-level measures are provided in the dependent claims.

The coupling device can appropriately include a coupling half which is provided on the side of the extension arm and includes two clamping jaws which are mutually adjustable by an associated drive device that is appropriately formed as a hydraulic cylinder, and a coupling half which is provided on the side of the working device and includes an engagement element which can be inserted between the clamping jaws. These measures advantageously produce a quick-action coupling device which can be actuated mechanically and can therefore be operated from the driver's cabin.

At least one element of a coupling half can advantageously include a recess into which an associate projection of an element of the other coupling half can be inserted. This leads to an interlocking connection and thus to a high level of safety.

A further advantageous measure can be that the working device is associated with a support frame which can be brought into engagement with the retaining device on the vehicle side and which includes a coupling half associated with the additional working device. A very simple and useful configuration can thus be achieved, wherein the support frame assumes the connecting function to the extension arm and the retaining device, such that the working device itself can be free from respective devices.

The extension arm can advantageously be extensible in a telescopic manner, wherein the coupling half on the extension arm side is appropriately attached in a telescopic manner to the extensible extension part of the extension arm. A great radius of action for the additional working device is thus achieved. At the same time, the performance of the coupling process is facilitated. This advantage can be promoted even further in such a way that at least one rear section of the extension arm which can be extended telescopically is arranged in a liftable and lowerable manner, so that an axial movement as well as a vertical movement are available for the coupling process.

The retaining device can advantageously be provided in the region of the rear side of the container. This allows advantageous handling and compact housing of the additional working device. For the purpose of promoting this advantage, a rearwardly opening recess which is associated with the retaining device can be provided in the region of the rear end of the container, into which the working device can be positioned at least in part.

A further appropriate measure can be that the retaining device is formed as a suspension element, appropriately in form of at least one rearwardly protruding supporting bar or supporting bracket. It is thus ensured that the additional working device or the support frame that accommodates said working device can be pushed easily onto the supporting bar or removed therefrom.

BRIEF DESCRIPTION OF THE DRAWINGS

The invention will now be described with reference to the drawings wherein.

DESCRIPTION OF EXEMPLARY EMBODIMENTS

The fields of application of the invention are vehicles for cleaning sewers, which are used not only for cleaning purposes but also for carrying out further work on the sewer, e.g. inspection of the sewer by a camera inserted into the sewer and/or carrying out repair work etc. Additional working devices in form of respectively formed special devices are required for carrying out such additional work on the sewer which goes beyond the cleaning of the sewer. The special devices are accommodated on the vehicle and are manipulable by said vehicle.

Figure 1:
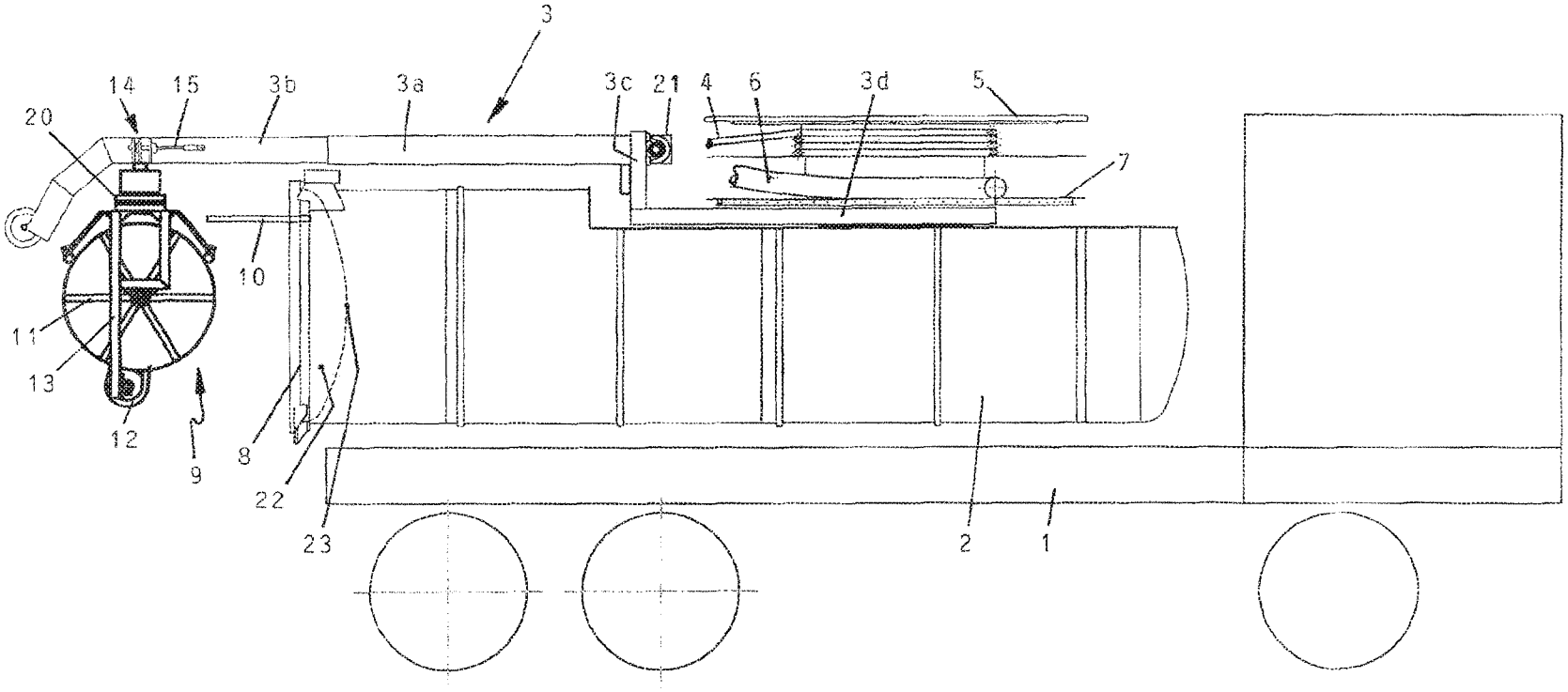
FIG. 1 shows a sewer cleaning vehicle with an additional working device for carrying out inspection of the sewer in the working state.
Figure 2:
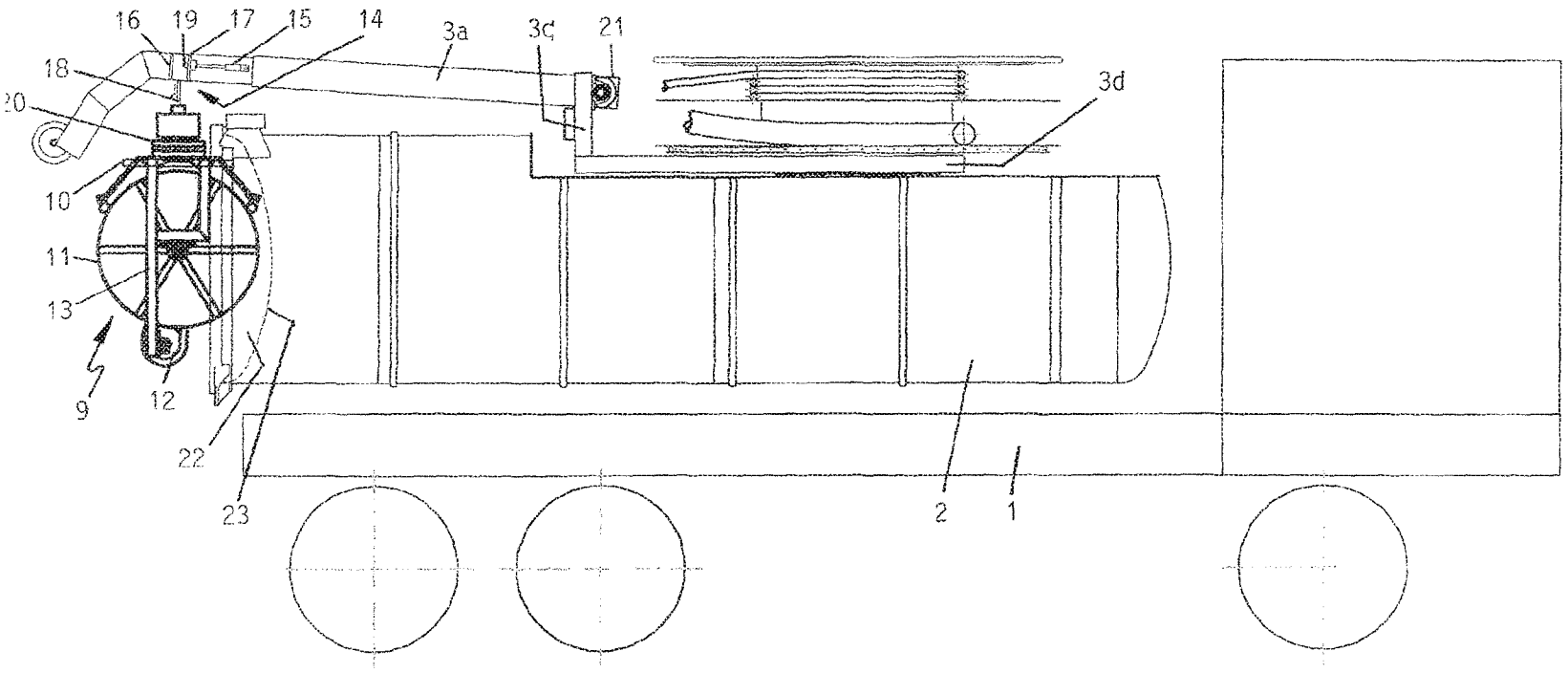
FIG. 2 shows the arrangement according to FIG. 1 in carrying out the coupling process.
Figure 3:
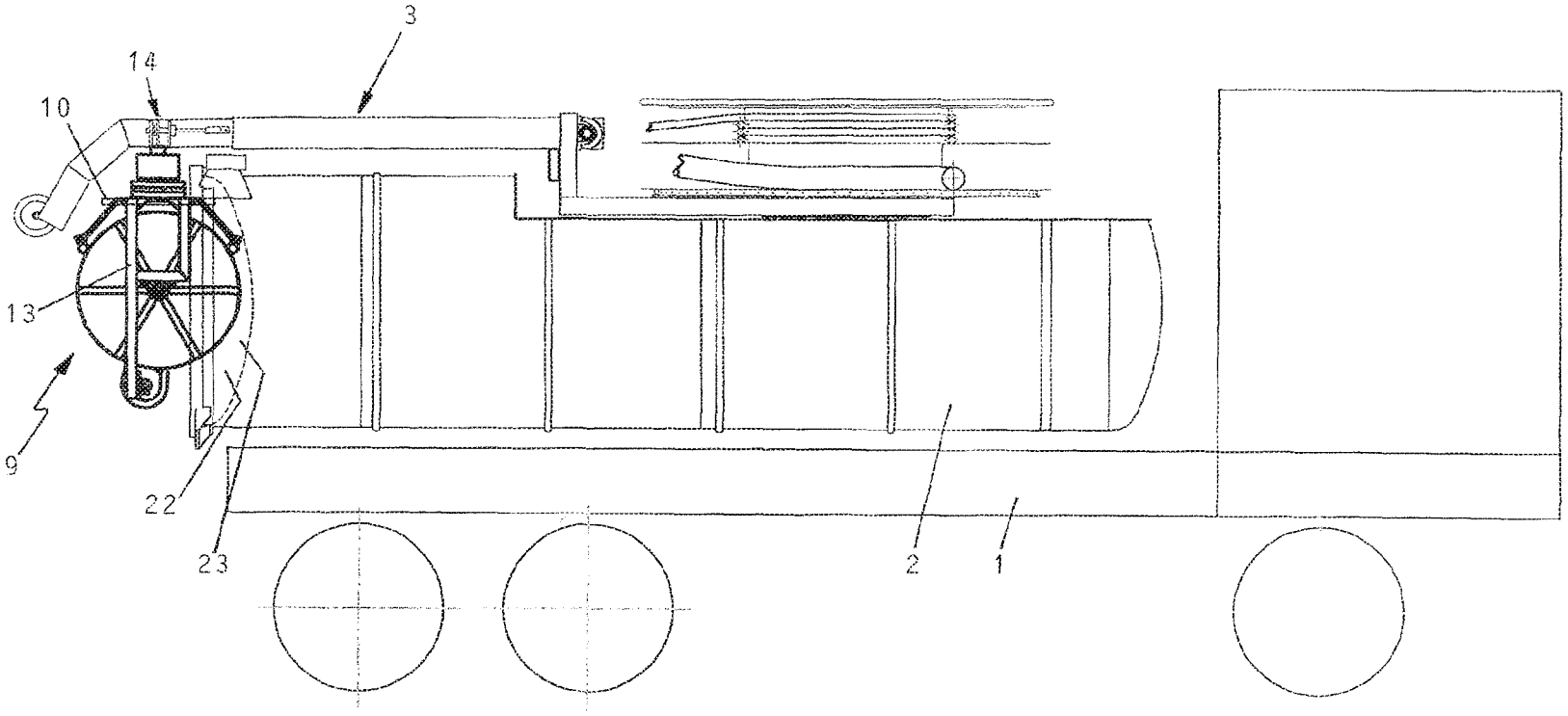
FIG. 3 shows the arrangement according to FIG. 1 in the driving state.

The sewer cleaning vehicle shown in FIGS. 1 to 3 contains in the known manner a movable chassis 1, an appropriately barrel-shaped container 2 which is accommodated on said chassis, an extension arm 3 which is accommodated on said barrel, as well as a flushing hose reel 5 which is associated with a flushing hose 4 which can be inserted into the sewer, and a suction hose reel 7 which is associated with a suction hose 6 which can be lowered into the sewer. The barrel-shaped container 2 is subdivided by intermediate walls, which are not shown in closer detail, into several chambers, preferably in form of a water container for the flushing water required during cleaning of the sewer and a sludge container for receiving the sludge obtained during cleaning of the sewer. A hinged lid 8 is provided at the rear end of the container 2, said hinged lid being opened for discharging the sludge container. The container 2 can be tilted upwardly at the front for discharging the sludge container or it can be provided with a discharge piston.

The flushing hose 4 and the suction hose 6 extend via the extension arm 3 into the sewer and can therefore be manipulated by the extension arm 3. It is telescopically extensible to the rear and accordingly contains a push-out part 3*b* that can be pushed out to the rear from an associated support part 3*a*. The support part 3*a* is connected via a step 3*c* to a mounting part 3*d*, which contains the mounting of the extension arm 3. It is rotatably mounted about a vertical axis on the container 2. The flushing hose reel 5 and the suction hose reel 7 are arranged in the illustrated example above one another with an axis which is coaxial to the axis of the extension arm 3. The reel assembly formed in this manner is positioned in the recess formed by the step 3*c* of the extension arm 3.

In the illustrated exemplary embodiment, a working device 9 which is suitable for carrying out the inspection of a sewer is carried along on the sewer cleaning vehicle, which working device can be manipulated in use by the extension arm 3 and can be positioned otherwise on a retaining device 10 on the vehicle side. The working device 9 in the illustrated example consists of a reel 11 which is rotatably mounted about a horizontal axis and is provided for a special high-pressure hose, to which a special sewer nozzle 12 fitted with a camera is attached. It is fitted with return-jet nozzles, which are arranged in such a way that a propulsion force is obtained and the camera is held at the desired height. The reel 11 is appropriately mounted on a support frame belonging to an assembly forming the working device 9. The working device 13 provided with a separate support frame forms an assembly which is separate from the sewer cleaning vehicle. Such a working device 9 can be carried along as an additional device and can be connected to the extension arm 3 when required. It is thus ensured that the extension arm 3 does not carry the working device permanently, but only when required.

The working device 9 which is carried along by the sewer cleaning vehicle can be accommodated loosely on the associated retaining device 10 which is provided on the vehicle side. For this purpose, the support frame 13 of the working device 9 is brought into loose engagement with the retaining device 10. The working device 9 can be connected by a coupling device 14 to the extension arm 3 for the purpose of activation for use, for which purpose it can be removed in this manner from the retaining device 10, manipulated as required in use and subsequently returned to the retaining device 10. The coupling device 14 according to FIG. 2 contains a coupling half which is provided on the side of the extension arm and includes two clamping jaws 16, 17 which are adjustable against each other by an associated drive device 15 which can be formed as a hydraulic cylinder, and a coupling half provided on the side of the working device and having an engagement element which can be clamped between the clamping jaws 16, 17 and is appropriately provided in form of a clamping plate 18. One element of the coupling device, appropriately the clamping plate 18, is provided with a recess, into which a projection 19 of another element of the coupling device which comes into engagement therewith can be inserted, appropriately the clamping jaw 17, which can be displaced by the drive device 15. The aforementioned measures produce an interlocking quick-action coupling device.

The coupling half associated with the extension arm 3 is appropriately arranged in the region of a side flank of the extension part 3*b* of the extension arm 3. The coupling half which is provided on the side of the working device, which is provided here in form of a coupling plate 18, is provided on the upper side of the support frame 13 and is connected thereto in a supporting manner. In the illustrated exemplary embodiment, the support frame 13 is connected via a swivel joint 20 to the clamping plate 18. It is thus possible to rotate the working device 9 which is connected to the extension arm 3 and is thus manipulable about the axis of the swivel joint 20, which allows steering the special high-pressure hose of the working device 9, which hose is inserted into the sewer and is unreeled from the reel 11.

In operation, the working device 9, as shown in FIG. 1, is suspended from the extension arm 3 and can be manipulated by said arm, i.e. the special high-pressure hose of the working device 9, which can be unreeled directly from the associated reel 11 via the extension arm 3 into the sewer, can be manipulated by respective actuation of the extension arm 3.

For the purpose of coupling the working device 9 to the extension arm 3, the clamping jaws 16, 17 which face away from each other are brought by the extension arm 3 to a position flanking the clamping plate 18 and are subsequently moved towards each other so that clamping of the clamping plate 18 is carried out. The clamping jaws 16, 17 are moved apart for decoupling and thus brought out of engagement with the clamping plate 18. For the purpose of moving the clamping plate 18 into and out of the gap bounded by the clamping jaws 16, 17, the extension arm 3 can be laterally pivoted in the downward direction and/or lifted.

The extension part 3*b* of the extension arm 3 which carries the coupling half on the extension arm side is mounted in the support part 3*a* and can therefore be lifted and lowered with said part. The support part 3*a* is pivotably connected in the illustrated example to the step 3*c* and provided with a suitable lifting device 21. After termination of use, the working device 9 which is still suspended on the extension arm 3 is deposited as shown in FIG. 3 by respective actuation of the extension arm 3 on the associated retaining device 10 which is provided on the vehicle side, in that the support frame 13 is brought by respective movements of the extension arm 3 into engagement with the retaining device 10 provided on the vehicle side.

The aforementioned retaining device 10 on the vehicle side is appropriately arranged in the region of the rear side of the container 2. In the illustrated exemplary embodiment, the retaining device 10 is formed as a supporting bar or supporting bracket arrangement which forms a suspension device and protrudes from the container 2 to the rear. One or advantageously several parallel supporting bars or bracket arrangements can be provided for forming the retaining device in order to ensure stable accommodation of the working device.

The working device 9 which is carried along and includes its support frame 13 can be pushed easily onto such a retaining device 10 or removed therefrom again. For this purpose, the coupling device 14, as shown in FIG. 3, is closed so that the working device 9 is coupled to the extension arm 3 and can be brought by means thereof into and out of engagement with the retaining device 10. For the purpose of activating the working device 9, it is brought from the travelling position as shown in FIG. 3 to the working position as shown in FIG. 1. This is carried out in the illustrated exemplary embodiment in such a way that the extension part 3*b* of the extension arm 3 is extended to the rear. After terminating the use, the working device 9 is brought in the reverse direction from the working position shown in FIG. 1 to the travelling position shown in FIG. 3, and placed on the retaining device 10 in this process.

If the vehicle remains on site and the extension arm 3 is used in a different way, the working device 9, which is accommodated on the retaining device 10, and the extension arm 3 are separated. As shown in FIG. 2, the coupling device 14 is opened for this purpose and the extension arm 3 is moved in such a way that the clamping plate 18 forming the coupling half on the side of the working device is released. In the illustrated exemplary embodiment, the support part 3*a* of the extension arm 3 is simply tilted upwardly to such an extent that the clamping plate 18 moves completely out of the gap between the two clamping jaws 16, 17. In the case of a change of location, i.e. while the vehicle carries out travelling movements, the working device 9 accommodated on the retaining device 10 is appropriately secured. A separate locking system can be provided for this purpose. The securing can appropriately be carried out by the extension arm 3, in that after terminating the pushing motion of the working device 9 onto the retaining device 10, the coupling device 14 remains closed as shown in FIG. 3 or the extension arm 3 is brought to the position as shown in FIG. 3 and the coupling device 14 is closed.

In the illustrated exemplary embodiment, a recess 22 is provided in the region of the rear end of the container 2, which recess is associated with the retaining device 10, is open to the rear and protrudes into the container 2, and into which the working device 9 accommodated in the retaining device 10 can at least partly enter as shown in FIG. 3, which allows space-saving housing in the driving position and reduces the length of the vehicle. For the purpose of forming the recess 22, which protrudes into the container 2, the wall 23 of the lid, which usually bulges in the outward direction to the rear, and which is indicated simply in the drawings by a dashed line, can also bulge inwardly.

The working device 10, which is loosely accommodated on the retaining device 10, and which can be brought into and out of coupling engagement with the extension arm 3, can easily be unloaded and replaced by another working device for other work in the sewer. The different working devices can be accommodated alternatively on the retaining device 10 as exchangeable units and can be brought into coupling engagement with the extension arm 3. The described exemplary embodiment is based on a working device 9 which is provided for inspecting a sewer. A different working device which is suitable for cutting concrete etc., for example, can be formed in a similar way, wherein it is necessary to provide a special high-pressure hose which is suitable for high pressures and a special sewer nozzle which is provided with a cutting nozzle.

It is understood that the foregoing description is that of the exemplary embodiments of the invention and that various changes and modifications may be made thereto without departing from the spirit and scope of the invention as defined in the appended claims.

What is claimed is:

1. A vehicle for cleaning sewers, comprising a container for water required for cleaning the sewer and/or the sludge obtained during cleaning of the sewer, and comprising a liftable and lowerable extension arm which is accommodated on the container and is rotatable about a vertical axis for manipulation of a flushing hose which can be supplied with compressed water and can be inserted into the sewer, and/or a suction hose which can be supplied with a suction draft and can be lowered into the sewer, wherein an additional working device which is provided for work in the sewer can be carried along on the vehicle, which working device can be loosely accommodated on an associated retaining device provided on the vehicle and can be manipulated by the extension arm, and which can releasably be coupled to the extension arm by an associated coupling device.

2. A vehicle according to claim 1, wherein the coupling device comprises a coupling half provided on the extension arm and having two clamping jaws which are adjustable against each other by an associated drive device, and a coupling half provided on the working device and having an engagement element which can be clamped between the clamping jaws.

3. A vehicle according to claim 2, wherein at least one element of the coupling half provided on the working device comprises a recess, into which an associated projection of an element of the respective other coupling half can be inserted.

4. A vehicle according claim 2, wherein a support frame is associated with the working device, which support frame can be brought into and out of engagement with the retaining device on the vehicle and comprises the coupling half provided on the working device.

5. A vehicle according to claim 1, wherein the extension arm is telescopically extensible, and a coupling half provided on the extension arm is attached to a telescopically extensible extension part of the extension arm.

6. A vehicle according to claim 5, wherein the coupling half provided on the extension arm is attached in a region of a side flank of the extension arm.

7. A vehicle according to claim 5, wherein the extension arm comprises a support part which accommodates the extension part and which is attached in a liftable and lowerable manner to a mounting part of the extension arm.

8. A vehicle according to claim 5, wherein the coupling half provided on the extension arm is attached in a region of the telescopically extensible extension part of the extension arm.

9. A vehicle according to claim 1, wherein the retaining device is provided in the region of a rear side of the container.

10. A vehicle according to claim 9, wherein the retaining device is associated with an outwardly open recess which protrudes into the container and into which the working device can be moved at least in part.

11. A vehicle according to claim 9, wherein the retaining device is formed as a suspension element.

12. A vehicle according to claim 9, wherein the suspension element includes at least one rearwardly protruding supporting bar or a supporting bracket arrangement.

13. A vehicle according to claim 1, wherein the additional working device comprises a rotatably mounted reel for a special high-pressure hose, which carries a sewer nozzle fitted with a camera and/or a cutting device at its front end that can be inserted into the sewer.

14. A vehicle according to claim 1, wherein working devices used alternatively can be accommodated as exchangeable devices in an alternative manner on the retaining device and can be coupled to the extension arm.

* * * * *